US009692185B2

(12) United States Patent
Yamaguchi

(10) Patent No.: US 9,692,185 B2
(45) Date of Patent: Jun. 27, 2017

(54) SHIELDED CONNECTOR

(71) Applicant: Yazaki Corporation, Tokyo (JP)

(72) Inventor: Yasuhiro Yamaguchi, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/892,347

(22) PCT Filed: Jun. 6, 2014

(86) PCT No.: PCT/JP2014/065092
§ 371 (c)(1),
(2) Date: Nov. 19, 2015

(87) PCT Pub. No.: WO2014/199918
PCT Pub. Date: Dec. 18, 2014

(65) Prior Publication Data

US 2016/0104974 A1 Apr. 14, 2016

(30) Foreign Application Priority Data

Jun. 11, 2013 (JP) ..... 2013-122694

(51) Int. Cl.
*H01R 13/6581* (2011.01)
*H01H 85/47* (2006.01)
(Continued)

(52) U.S. Cl.
CPC ..... *H01R 13/6581* (2013.01); *H01H 85/02* (2013.01); *H01H 85/202* (2013.01);
(Continued)

(58) Field of Classification Search
CPC .. H01R 13/6581; H01R 13/68; H01R 13/684; H01H 85/02; H01H 85/202; H01H 85/47
(Continued)

(56) References Cited

U.S. PATENT DOCUMENTS 4,297,668 A * 10/1981 Place ..... H01H 37/5436 248/229.26
5,186,637 A * 2/1993 Norden ..... H01H 85/547 337/211

(Continued)

FOREIGN PATENT DOCUMENTS

CN 102422493 A 4/2012
CN 103022826 A 4/2013
JP 2004-273381 A 9/2004

OTHER PUBLICATIONS

International Search Report mailed Jul. 8, 2014, issued for PCT/JP2014/065092.

(Continued)

*Primary Examiner* — Alexander Gilman
(74) *Attorney, Agent, or Firm* — Locke Lord LLP

(57) ABSTRACT

The present invention provides a shielded connector that can reduce the entire size thereof while preventing an increase in the number of components. A shielding shell includes a shell body provided to an outer side of a housing, and a thermally conductive holding member that supports an insulating container portion of a fuse, so the heat generated by the fuse is dissipated to outside, thereby reducing the space between the housing and the fuse and reducing the entire size of the shielded connector. Also, the shielding shell functions as both a heat dissipation member and a magnetic shield, thus, an increase in the number of components can be prevented.

4 Claims, 4 Drawing Sheets

(51) Int. Cl.
*H01R 13/684* (2011.01)
*H01H 85/20* (2006.01)
*H01H 85/02* (2006.01)
*H01R 13/68* (2011.01)

(52) U.S. Cl.
CPC ..... *H01H 85/47* (2013.01); *H01R 13/68* (2013.01); *H01R 13/684* (2013.01)

(58) Field of Classification Search
USPC ..... 439/766, 762, 607.01; 174/66; 337/191, 337/189
See application file for complete search history.

(56) References Cited

U.S. PATENT DOCUMENTS 5,524,327 A * 6/1996 Mickel ..... F16L 3/00 24/115 A
6,144,283 A * 11/2000 Matsumura ..... H01H 37/761 29/623
6,417,758 B1 * 7/2002 Russell ..... H01H 37/043 165/80.1
6,512,443 B1 * 1/2003 Matsumura ..... H01H 85/044 337/161
6,577,495 B2 * 6/2003 West ..... H01H 85/202 337/194
6,814,486 B2 * 11/2004 Sidoni ..... G01K 1/143 374/147
7,543,983 B2 * 6/2009 Wu ..... G01K 1/143 374/141
7,663,466 B1 * 2/2010 Jetton ..... H01H 85/044 337/186
7,920,044 B2 * 4/2011 Scheiber ..... D06F 58/26 337/186
8,026,786 B2 * 9/2011 Darr ..... H01H 85/203 337/180
8,400,252 B2 * 3/2013 Jung ..... H01H 85/0052 337/182
8,400,253 B2 * 3/2013 Jung ..... H01H 69/02 337/182
8,636,550 B2 * 1/2014 Onoda ..... H01R 13/447 439/762
8,721,367 B2 * 5/2014 Matsumoto ..... H01H 85/12 439/620.26
9,484,170 B2 * 11/2016 Ikeda ..... H01H 85/0017
2002/0134572 A1 * 9/2002 Matsumura ..... H01H 85/044 174/66
2004/0056158 A1 * 3/2004 Stuart ..... F16L 3/13 248/74.2
2009/0033453 A1 * 2/2009 Deno ..... H01H 85/547 337/205
2010/0148913 A1 * 6/2010 Hemmingway ..... H01H 31/125 337/214
2012/0094537 A1 * 4/2012 Aoki ..... H01R 13/688 439/620.26

OTHER PUBLICATIONS

Office Action dated on Nov. 2, 2016 issued for corresponding Chinese Patent Application No. 2016102800977980.

* cited by examiner

SHIELDED CONNECTOR

TECHNICAL FIELD

The present invention relates to a shielded connector including terminals provided to ends of at least a pair of electric wires, and a housing that houses the terminals.

BACKGROUND ART

Conventionally, a shielded connector provided with a fuse in a housing has been proposed (see for example, Patent Literature 1). In the shielded connector described in Patent Literature 1, a fuse serving as a protection element is connected in series to an electric wire to protect a circuit.

CITATION LIST

Patent Literature

Patent Literature 1: JP 2004-273381 A

SUMMARY OF INVENTION

Technical Problem

However, the shielded connector described in Patent Literature 1 has a problem that it requires an appropriate space between the fuse and the housing in order to prevent the housing from being deteriorated due to the heat generated by the fuse, causing an increase in size of the housing, which results in increase in size of the entire shielded connector. Even if a heat dissipation member is provided to the fuse to downsize the housing, there is still a problem of an increase in the number of components.

In view of the above-mentioned problems, an object of the present invention is to provide a shielded connector which can reduce the entire size of the shielded connector while preventing an increase in the number of components.

Solution to Problem

A shielded connector of the present invention includes terminals provided to ends of at least a pair of electric wires, and a housing that houses the terminals. The shielded connector includes: a protection element housed in the housing and connected in series between the electric wires and the terminals to protect a circuit; and a shielding shell attached to an outer side of the housing so as to cover the protection element. The shielding shell includes a thermally conductive holding member which holds the protection element.

According to the present invention described above, the thermally conductive holding member is provided to the shielding shell. Thus, even when the protection element generates heat, the heat is conducted from the protection element to the holding member, and is conducted and transferred within the shielding shell having the holding member, and then the heat is dissipated to outside. Thus, the rise in temperature inside the housing can be prevented, and the space between the protection element and the housing can be reduced, thereby downsizing the housing and reducing the entire size of the shielded connector. The shielding shell and the holding member may be formed integrally, i.e., formed as one part, or may be formed as separate parts and arranged to contact each other.

The generated heat is dissipated to the outside by the shielding shell. Thus, the shielding shell functions as a magnetic shield and functions also as a heat dissipation member, thereby preventing an increase in the number of components.

Preferably, in the shielded connector of the present invention, the housing is made of an insulating resin, and the protection element is a fuse which includes a pair of terminal portions, a conductive portion connecting the pair of terminal portions to each other, and an insulating container portion housing the conductive portion, and the holding member includes a support portion which supports the container portion.

According to the configuration mentioned above, the fuse is housed in the insulating housing, and the insulating container portion is supported by the support portion, thereby insulating the fuse from the outside even if the holding member has conductivity.

Furthermore, in the shielded connector of the present invention, it is preferable that the support portion is a grip portion that is made of an elastically deformable member and that has an inner side having a shape that follows a side face of the container portion. The grip portion is elastically deformed outward by the container portion and grips the container portion by the inwardly exerted restoring force.

According to this configuration, since the grip portion grips the container portion by the restoring force, an increase in the number of components can be prevented while reliably supporting the container portion. Furthermore, the inner side of the grip portion has a shape that follows the shape of the container portion and grips the container portion by the restoring force. Thus, a contact area in which the container portion and the grip portion contact with each other can be ensured, thereby efficiently transferring the heat.

Moreover, in the shielded connector of the present invention, it is preferable that the support portion includes: a pair of clamping portions that is formed to have an inner side with a shape following a side face of the container portion and that clamps, i.e. holds in a sandwiching fashion, the container portion; and a fixing portion that fixes the pair of clamping portions so as to keep the container portion clamped by the pair of clamping portions.

According to this configuration, the container portion is clamped by the clamping portion, and the clamping portion is fixed by the fixing portion. Thus, the container portion can be supported in an even more reliable manner. Furthermore, since the inner side of the clamping portion has a shape that follows the container portion, the heat can be transferred efficiently as mentioned above.

Advantageous Effects of Invention

With the shielded connector according to the present invention described above, by providing the thermally conductive holding member to the shielding shell, the entire size of the shielded connector can be reduced while preventing an increase in the number of components.

EXEMPLARY EMBODIMENTS OF INVENTION

Figure 1A:
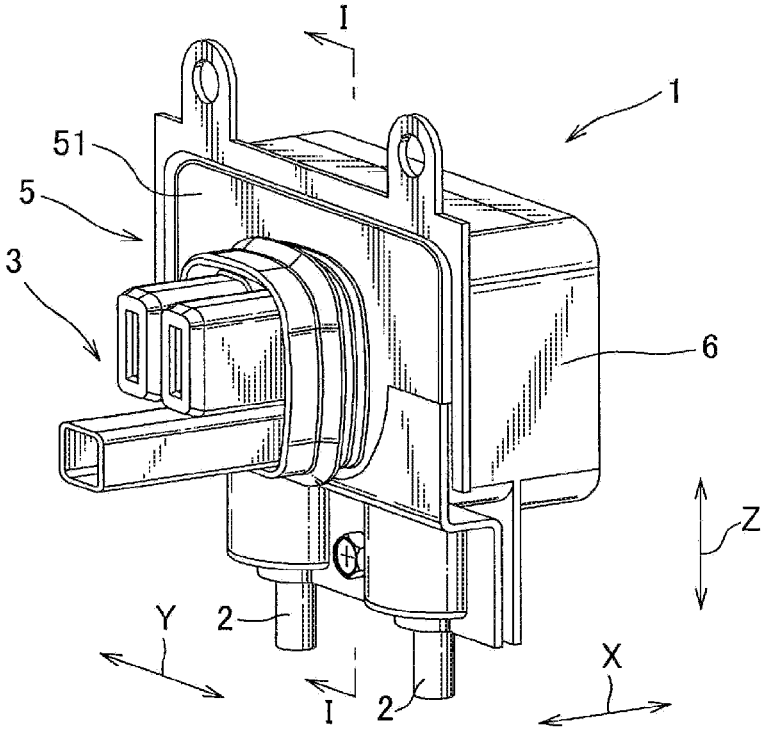
FIGS. 1A and 1B are a perspective view and a sectional view, respectively, illustrating a shielded connector according to an embodiment of the present invention.
Figure 1B:
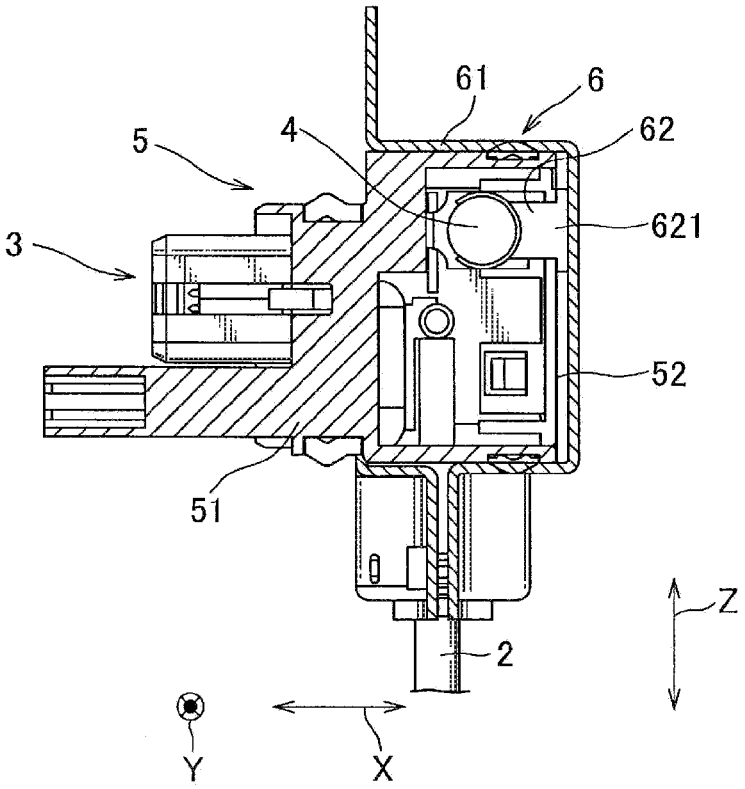
Figure 2:
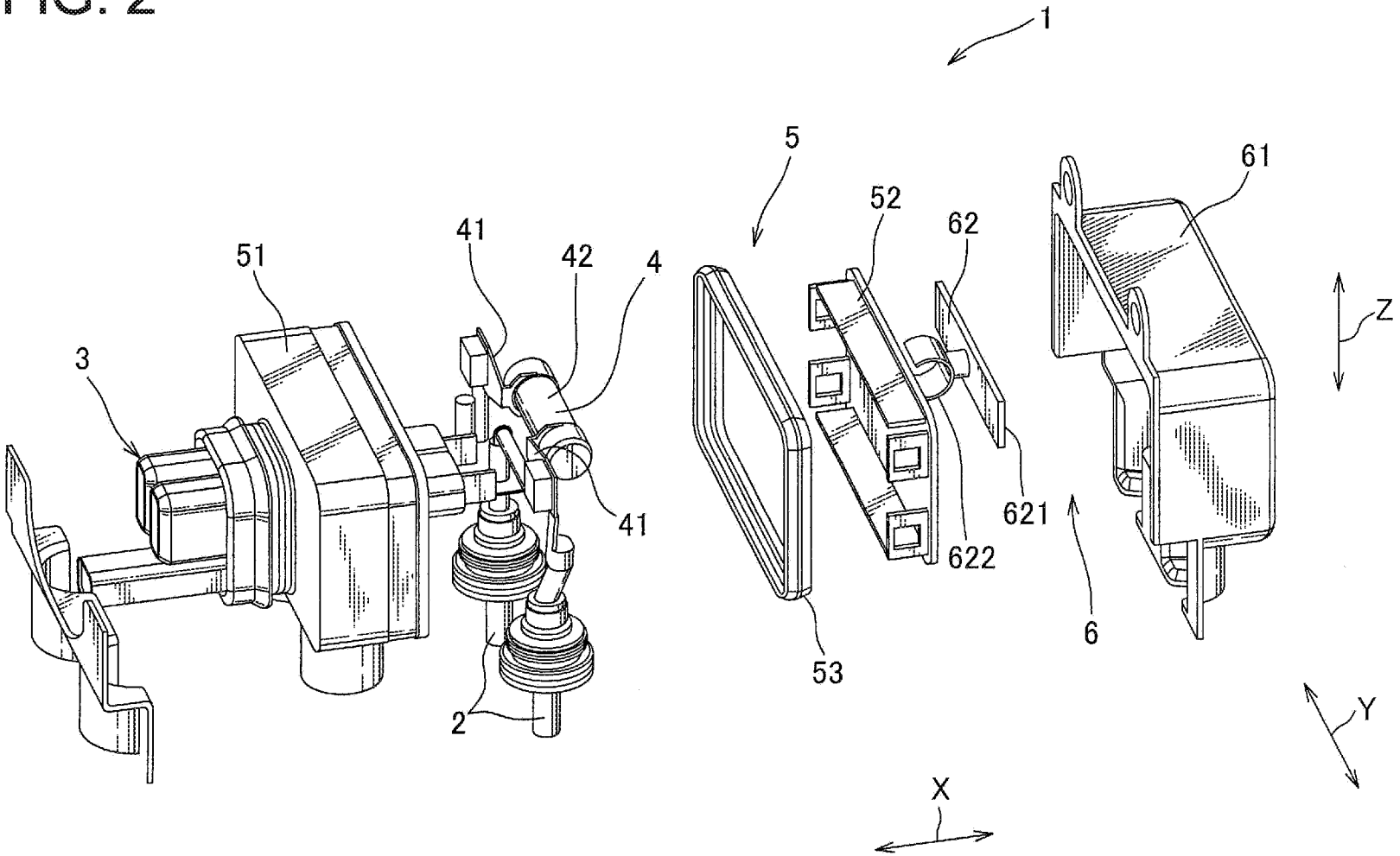
FIG. 2 is a perspective view illustrating inside of the shielded connector.

An exemplary embodiment of the present invention will be described below with reference to the drawings. As illustrated in FIGS. 1A, 1B, and 2, a shielded connector 1 according to this embodiment includes a pair of electric wires 2, terminals 3 provided at ends of the respective electric wires 2, a fuse 4 as a protection element connected in series to one of the pair of electric wires 2, a housing 5 which houses the terminals 3 and the fuse 4, and a shielding shell 6 attached to an outer side of the housing 5. In this embodiment, the shielded connector 1 is provided to a vehicle for supplying power to an electric device. Ends of the electric wires 2 opposite to the terminals 3 are connected to a side of the electric device, and the terminals 3 are to be connected to a separately-provided source-side connector. In this embodiment, an X direction, a Y direction, and a Z direction are as illustrated in FIGS. 1A and 1B, and an up-down direction of the Z direction is based on FIGS. 1A and 1B.

Figure 3A:
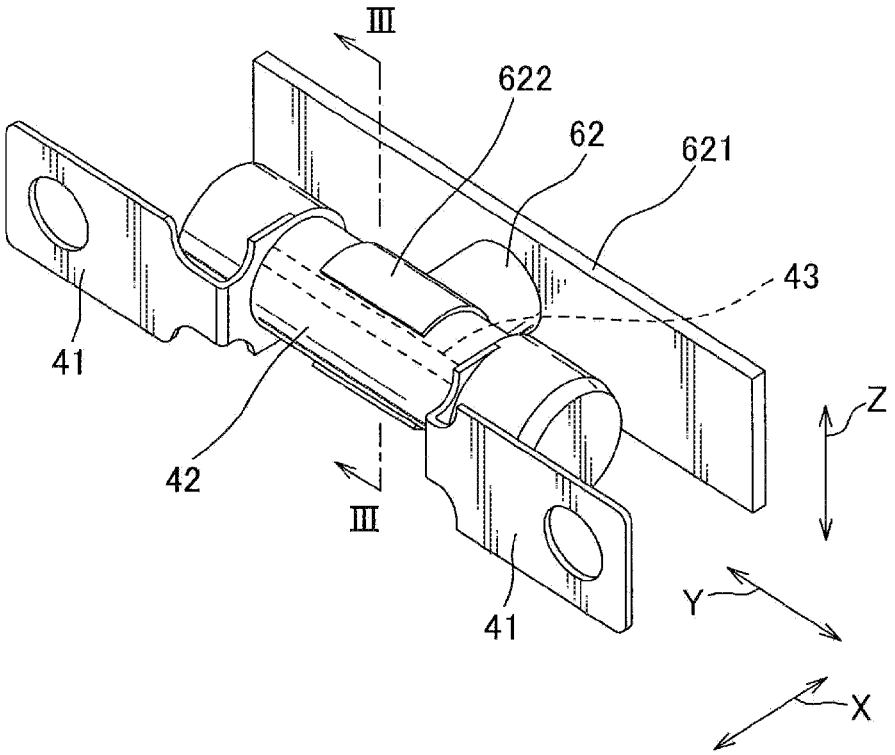
FIGS. 3A and 3B are a perspective view and a sectional view, respectively, illustrating a main part of the shielded connector.
Figure 3B:
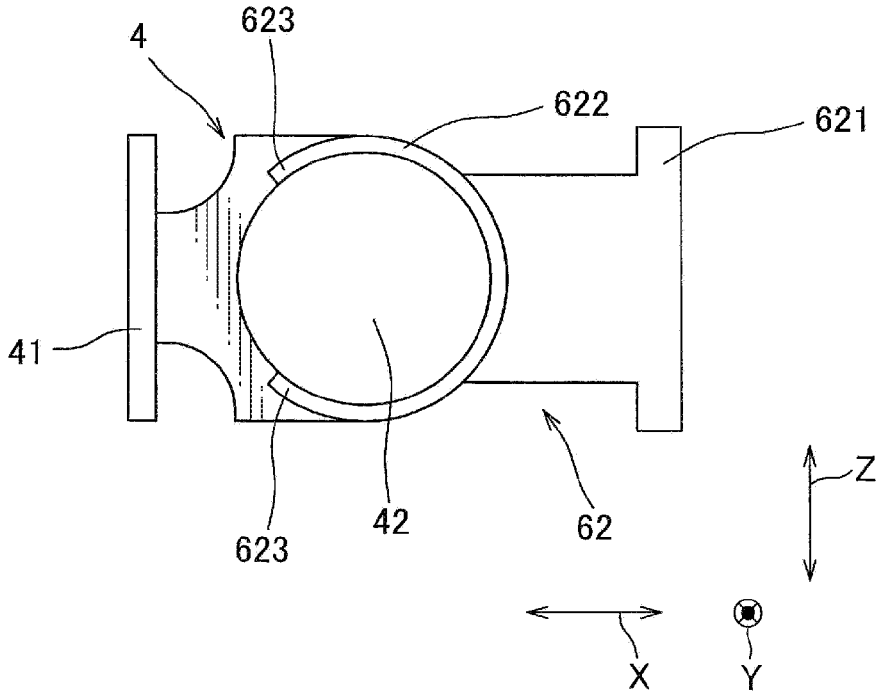

As also illustrated in FIGS. 3A and 3B, the fuse 4 includes a pair of conductive terminal portions 41 provided at both ends thereof, a container portion 42 provided between the pair of terminal portions 41, and a conductive portion 43 provided in the container portion 42 for connecting the pair of terminal portions 41 to each other. The pair of terminal portions 41 is electrically connected to the electric wires 2. The container portion 42 is made of an insulating material such as a glass for electrically insulating the conductive portion 43 from outside. The conductive portion 43 has appropriate electric resistance such that it generates heat and is fused due to overcurrent flowing therethrough.

The housing 5 includes: a first body portion 51 having one face in the X direction into which the terminals 3 are inserted and another face which is opened; a second body portion 52 which covers the another face of the first body portion 51; and a packing 53 provided between the first body portion 51 and the second body portion 52. The first body portion 51 and the second body portion 52 are made of an insulating resin, and the packing 53 is made of an insulating elastic member such as a rubber, thereby insulating the inside of the housing 5 from the outside. In addition, the electric wires 2 are inserted into a lower portion in the Z direction of the first body portion 51.

The shielding shell 6 includes a shell body 61 which covers the housing 5 from the another side in the X direction, both sides in the Y direction, and both sides in the Z direction, and a holding member 62 provided between the second body portion 52 and the shell body 61 for supporting the fuse 4. The holding member 62 is in contact with the shell body 61 at a contact portion 621, thereby transferring the heat.

The holding member 62 has a grip portion 622 serving as a support portion, the grip portion 622 has an inner side shaped approximately into the same shape as an outer side of the container portion 42. FIG. 3B is a sectional view taken along a line III-III in FIG. 3A. When the container portion 42 is to be gripped by the grip portion 622, firstly, the holding member 62 and the fuse 4 are brought closer to each other in the X direction, and end portions 623 of the grip portion 622 are elastically deformed so as to move away from each other in the Z direction. When the holding member 62 and the fuse 4 are further moved closer to each other, the end portions 623 of the grip portion 622 move closer to each other by the restoring force, and the container portion 42 is in close contact with the inner side of the grip portion 622. In this manner, the grip by the grip portion 622 is completed. Here, the inner diameter of the grip portion 622 in a neutral state in which the container 42 is not gripped, is smaller than the outer diameter of the container portion 42. The restoring force is always exerted while the container portion 42 is gripped by the grip portion 622.

Next, a heat transfer mechanism for the heat generated by the fuse 4 due to overcurrent flowing through the electric wires 2, i.e., overcurrent flowing through the fuse 4, will be described with reference to FIG. 1B that is a sectional view along a line I-I in FIG. 1A, and FIGS. 3A and 3B. Heat generated by the conductive portion 43 of the fuse 4 is firstly transferred to the container portion 42. Then, the heat is transferred from the container portion 42 to the grip portion 622, and conducted within the holding member 62 from the grip portion 622 toward the contact portion 621. The heat is further transferred from the contact portion 621 to the shielding shell 6, and the heat is conducted in the shielding shell 6 and transferred to the outside air and dissipated.

The embodiment described above has the following advantageous effects. That is, since the fuse 4 is supported by the thermally conductive holding member 62, and the holding member 62 is in contact with the shielding shell 6 at the contact portion 621, the heat generated by the fuse 4 is dissipated in a manner described above, thereby reducing the temperature rise in the housing 5. Thus, deterioration of the resinous body portions 51 and 52 due to the temperature rise can be prevented, and thus the space between the fuse 4 and the resinous body portions 51 and 52 can be reduced, thereby reducing the entire size of the shielded connector 1.

Furthermore, as mentioned above, the shell body 61 of the shielding shell 6 covers the periphery of the housing 5, and the shielding shell 6 dissipates the heat generated by the fuse 4 to the outside as described above. Thus, the shielding shell 6 functions as a magnetic shield and also functions as a heat dissipation member, thereby preventing the increase in the number of components.

Moreover, as mentioned above, the holding member 62 supports the insulating container portion 42, and the fuse 4 is housed in the insulating housing 5. Thus, the terminal portion 41 of the fuse 4 can be insulated from the outside of the housing 5.

Since the heat generated by the fuse 4 is dissipated as described above, when the overcurrent flows, the temperature rise in the conductive portion 43 is decreased, and so the fusing of the conductive portion 43 is less likely to occur. Thus, the actual breaking capacity of the fuse 4 can be increased, allowing the use of a fuse for 30 A for a connector requiring the breaking capacity of 50 A, for example. Thus, by using a fuse with a small rating capacity, the cost can be reduced, and the entire size of the connector can be further reduced.

Furthermore, since the holding member 62 is made of an elastic member and has the grip portion 622 that grips the fuse 4 by the restoring force, the fuse 4 can be reliably supported while preventing the increase in the number of the components. Furthermore, since the inner side of the grip portion 622 follows the outer side of the container portion 42, and the inner diameter of the grip portion 622 is smaller than the outer diameter of the container portion 42, the grip portion 622 and the container portion 42 can be in close contact with each other with a large area. Thus, the heat is efficiently transferred between the grip portion 622 and the container portion 42.

Figure 4:
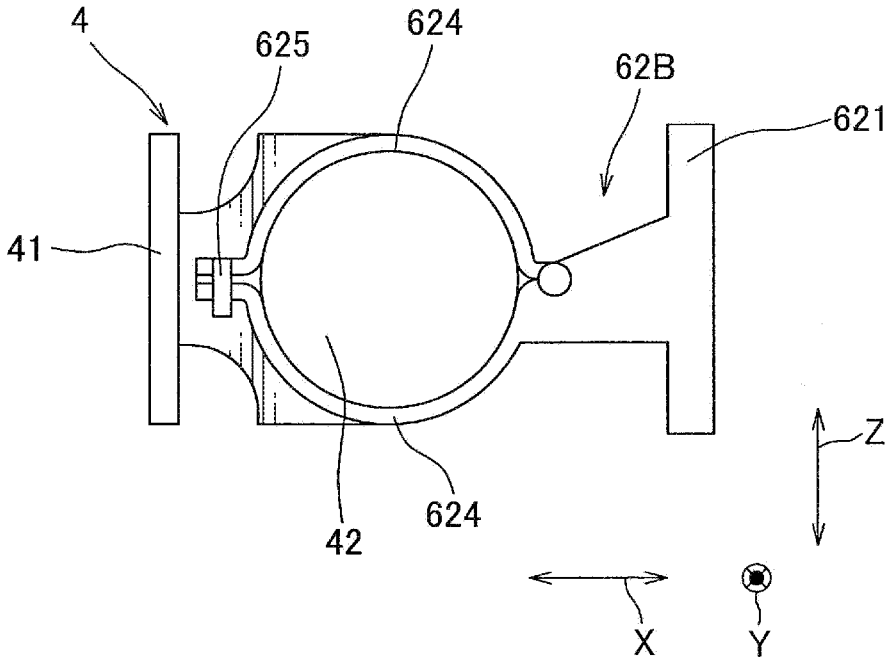
FIG. 4 is a sectional view illustrating a main part of a shielded connector according to a modified example of the present invention.

It should be noted that the present invention is not limited to the embodiment described above, and the present invention may include other configurations which can attain the object of the present invention. The present invention may include modifications as described below. For example, in the embodiment described above, the container portion 42 of the fuse 4 is supported by the grip portion 622 that is integrally formed with the holding member 62. However, as illustrated in FIG. 4, a holding member 62B may include a pair of clamping portions 624 and a claw portion 625 that serves as a fixing portion for keeping the state in which the pair of clamping portions 624 is positioned close to each other. The upper clamping portion 624 in the Z direction out of the pair of clamping portions 624 may freely rotate about the Y direction as a rotation axis. With this configuration, the fuse 4 can be supported by bringing the clamping portions 624 close to each other and fixing them by the claw portion 625. The fuse 4 can be removed by removing the claw portion 625 so s to separate the clamping portions 624 from each other. Thus, the fuse 4 can be replaced easily. Any appropriate support structure of the fuse 4 with a support portion may be employed, as long as the fuse 4 can be replaced and the heat is transferred between the fuse 4 and the support portion.

In the embodiment described above, the fuse 4 is provided as a protection element. However, the protection element may be any appropriate element which protects a circuit and is likely to generate heat. For example, the protection element may be a breaker which separates electrodes to shut off overcurrent.

In the embodiment described above, the shell body 61 covers the first body portion 51 and the second body portion 52 from the another side in the X direction, both sides in the Y direction, and both sides in the Z direction. However, the shell body may have any appropriate shape as long as it functions as a heat dissipation member and a magnetic shield and as long as the shell body is provided on at least the face on which the contact portion 621 is disposed (i.e., the another face in the X direction in the above embodiment) out of the side faces of the housing 5.

In the embodiment described above, the holding member 62 and the shell body 61 are provided in the separate parts. However, the holding member may be formed integral with, i.e. formed in one part with the shell body. Such configuration can reduce the number of components, thereby reducing the cost.

In the embodiment described above, the fuse 4 is connected in series to one of the pair of electric wires 2. However, the fuse 4 may be provided to both of the pair of electric wires 2, or provided between the terminals 3 and the electric wires 2. That is, the fuse 4 may be provided at an appropriate position for protecting a circuit with an appropriate connection method.

The preferable configurations and method for implementing the present invention have been described above; however, the present invention is not limited thereto. In other words, although a specific embodiment of the present invention is mainly illustrated and described, a variety of modifications may be made by those skilled in the art on shapes, materials, numbers, and other detailed configurations of the embodiment as described above without departing from the technical idea and object of the invention. Accordingly, the descriptions limiting shapes, materials, and the like disclosed above are only illustrative for facilitating understanding of the present invention, and do not limit the present invention. Therefore, description with names of members without all of or a portion of the limitations on shapes or materials are included in the scope of the present invention.

REFERENCE SIGNS LIST

1 Shielded connector
3 Terminal
4 Fuse (protection element)
41 Terminal portion
42 Container portion
43 Conductive portion
5 Housing
6 Shielding shell
62 Holding member
622 Grip portion (support portion)
624 Clamping portion
625 Claw portion (fixing portion)

The invention claimed is:

1. A shielded connector including terminals provided to ends of at least a pair of electric wires, and a housing that houses the terminals, the shielded connector comprising:

a protection element which is housed in the housing and connected in series between the two terminals to protect a circuit; and a shielding shell for shielding magnetism attached to an outer surface of the housing so as to cover the protection element, wherein the shielding shell includes a thermally conductive holding member which holds the protection element and is separated from the terminals.

2. The shielded connector according to claim 1, wherein the housing is made of an insulating resin, wherein the protection element is a fuse including a pair of terminal portions, a conductive portion which connects the pair of terminal portions to each other, and an insulating container portion which houses the conductive portion, and wherein the holding member includes a support portion which supports the container portion.

3. The shielded connector according to claim 2, wherein the support portion is a grip portion that is made of an elastically deformable member and that has an inner side having a shape that follows a side face of the container portion, and wherein the grip portion is elastically deformed outward by the container portion and grips the container portion by inwardly exerted restoring force.

4. The shielded connector according to claim 2, wherein the support portion includes a pair of clamping portions having an inner side with a shape that follows a side face of the container portion, and configured to clamp the container portion; and a fixing portion that fixes the pair of clamping portions so as to keep the container portion clamped by the pair of clamping portions.

* * * * *